United States Patent [19]

Tarpley, Jr. et al.

[11] 4,226,727

[45] Oct. 7, 1980

[54] PERSISTENT FIRE SUPPRESSANT COMPOSITION

[75] Inventors: William B. Tarpley, Jr., West Chester, Pa.; John R. Huzinec, Frostburg, Md.; Marion K. Freeman, West Chester, Pa.

[73] Assignee: Energy & Minerals Research Co., Kennett Square, Pa.

[21] Appl. No.: 926,786

[22] Filed: Jul. 21, 1978

[51] Int. Cl.[3] ..... A62D 1/00

[52] U.S. Cl. ..... 252/8; 169/47; 252/2; 252/3; 252/7

[58] Field of Search ..... 252/2, 3, 7, 8; 169/47

[56] References Cited

U.S. PATENT DOCUMENTS

| | | | |
|---|---|---|---|
| 3,258,423 | 6/1966 | Tuve et al. | 252/3 |
| 3,267,030 | 8/1966 | Dessart | 252/7 |
| 3,402,665 | 9/1968 | Tarpley, Jr. et al. | 102/65 |
| 3,609,074 | 9/1971 | Rainaldi | 252/3 |
| 3,655,554 | 4/1972 | Fink et al. | 252/3 |
| 3,976,580 | 8/1976 | Kaminstein et al. | 252/2 |
| 4,042,521 | 8/1977 | Dunn | 252/5 |

FOREIGN PATENT DOCUMENTS

| | | | |
|---|---|---|---|
| 227557 | 10/1959 | Australia . | |
| 406178 | 12/1966 | Australia | 252/2 |
| 1211493 | 2/1966 | Fed. Rep. of Germany . | |
| 1168092 | 10/1969 | United Kingdom . | |
| 1236075 | 6/1971 | United Kingdom . | |
| 1349508 | 4/1974 | United Kingdom . | |

OTHER PUBLICATIONS

Webster's Third New International Dictionary of the English Language, Unabridged, G & C. Merriam Co., Springfield, Mass., 1961, p. 2280.

*Primary Examiner*—Leland A. Sebastian

*Attorney, Agent, or Firm*—Seidel, Gonda, Goldhammer & Panitch

[57] ABSTRACT

A substantially nonaqueous persistent thixotropic fire suppressant composition comprises a fire suppressant agent, a carrier material, the suppressant agent permeating the carrier material to form a suppressant permeated carrier material, a fire extinguishing dispersant, the carrier material being insoluble in the dispersant, the permeated carrier material being suspended in the dispersant, and a gelling agent in an amount effective to thixotropically gel the suspension of permeated carrier material and dispersant, the permeated carrier material being capable of adhering to an object in the vicinity of combustion.

10 Claims, No Drawings

PERSISTENT FIRE SUPPRESSANT COMPOSITION

BACKGROUND OF THE INVENTION

This invention relates to substantially nonaqueous persistent thixotropically gelled fire suppressant compositions wherein a carrier material is permeated with a fire suppressant agent and is suspended in a thixotropically gelled fire extinguishing dispersant in which the carrier material is insoluble. When the suppressant composition is dispersed from any suitable container onto an object in the vicinity of the combustion, the fire is extinguished and reignition is prevented by the release of the suppressant agent permeating the carrier material over a period of time.

Several available fire extinguishing compositions are presently capable of extinguishing a fire, however, the problem of reignition still remains a high probability if hot spots and a fuel source remain present. These conditions are present in aircraft engine nacelles, on and off-road vehicles, engine and power train compartments, live electrical wire installations, motors, upholstery, etc.

The compositions of the present invention contain both extinguishing materials to quickly extinguish a fire and means for suppressing further combustion of combustible objects which are potential fuel sources.

Many prior art compositions, particularly in the form of aqueous forms, are claimed to have persistent qualities. Foam extinguishment involves the expansion of water with air or other gases to form a sticky, but flowable, stabilized foam. A layer of foam deposited on a burning object coats and separates the fuel from the flame front, minimizes contact with oxygen and provides some cooling action. Thus, the fire is smothered. Foams are generally inexpensive and relatively easy to apply on a large scale. One of their major advantages is that they will persist for many hours and prevent reignition. However, the quantities of water needed for the foam fire extinguishing agents are too great for portable units and they cannot be used on electrical fires. Also, post-fire clean-up can be a problem.

Another type of extinguishing material includes vaporizing liquid extinguishers. The flame interference of these extinguishers is believed to be due to thermal decomposition of the vaporizing liquid to give low concentrations of flame inhibitors which quench the chemical reactions of the flame. Chlorinated fragments, as from carbon tetrachloride and brominated fragments (as from bromochloromethane) are effective. The rate of thermal decomposition, which should be rapid, volatility, which should be intermediate, and mode of application are significant.

Dry powder extinguishing agents have also found widespread use. While it was initially thought that dry powder extinguishants functioned by decomposition to give $CO_2$ (which would smother the fire), it has been established that this is not the case. There is little measurable decomposition; and powders which cannot give $CO_2$ (such as $NH_4H_2PO_4$) are effective. $KHCO_3$ is twice as effective as $NaHCO_3$. These materials appear to react by virtue of their chemical surface with the flame propagating intermediates in a flame front. Dry powder clouds are believed also to exert a thermal shielding between the hot flame front and the cooler fuel. The 10–40 micron coated particles generally used appear to be a compromise between the need for a large number of particles (favoring smaller particle size), the need to penetrate the hot gases around the flame and be propelled to the flame front (favoring larger particles), and the need for flowability and storability without packing (hence, the coatings). The dry powders as conventionally used are necessarily very bulky and require relatively large extinguisher tanks.

The following patents disclose various types of fire extinguishing compositions and are believed to represent the closest prior art.

The closest disclosure is believed to be British Patent No. 1,349,508 of Cottrell et al. This patent discloses a fire extinguishing composition in the form of an aqueous gel which produces an incombustible adherent protective layer on burning materials to minimize reignition. The composition comprises an aqueous gel made by at least partially neutralizing an aqueous solution of an alkali metal silicate with an organic or inorganic acid or acidic salt. The acids preferred are those which, besides having a gelling agent themselves, possess some fire-fighting properties, for example phosphoric acids, boric acids and salts thereof. Although the precise chemical structure of the gels is not known, the gels are stable to mechanical agitation. In other words, the gels are not thixotropic.

The ingredients of the patented composition initially may be in the form of powders to be mixed with and dissolved in water to form the aqueous gels. Flow additives such as precipitated silica may be added to the powders to prevent caking on storage or transport or to aid the flow of the powder into a dissolution vessel or water stream. Other compounds may be added to the aqueous mixture before or after gelling. The additives may modify the viscosity of the gel to make it more suitable for spraying or to modify the surface properties of the gel to aid its flow or conversely to increase the adhesion of the gel to the surfaces of combustible material.

The Cottrell et al. patent also discloses incorporating an organic compound, which may be for example a fire-retardant compound, into the gelling composition and allowing the volatilization of the organic compound to blow the composition to a foam. Suitable compounds include fluorocarbons optionally containing chlorine and/or bromine and preferably containing not more than 3 carbon atoms. Especially suitable compounds are disclosed as being bromochlorodifluoromethane, bromopentafluoroethane, dibromodifluoromethane, 1,2-dibromotetrafluoroethane, and bromotrifluoromethane. The addition of 1 to 5 percent of high surface area silica to the composition containing volatile fluorocarbons is disclosed as being advantageous because the undesirable phase separation of components on storage is minimized.

The Cottrell et al. patent neither discloses nor suggests the present invention. The present invention relates to a thixotropically gelled fire extinguishing composition wherein a fire suppressant agent permeates a carrier material. The carrier material permeated with suppressant agent is insoluble in a fire extinguishing dispersant agent into which it is suspended. The entire composition of the present invention is then thixotropically gelled to provide a stable suspension which is easily transported and dispensed. The permeated carrier material adheres to objects in the vicinity of combustion to suppress combustion by slowly releasing the suppressant agent permeating the carrier material.

Moroever, the gelled dispersant agent does not itself adhere to the object. Rather, the dispersant agent almost immediately volatizes to disperse the permeated carrier material and to smother, cool and combine with the free radicals of the combustion process to break the combustion chain, thereby extinguishing a fire to which the composition is applied. Cottrell et al. does not disclose a composition containing insoluble carrier material permeated with fire suppressant agent which is suspended in a thixotropically gelled fire extinguishing dispersant agent.

U.S. Pat. No. 3,402,665 of Tarpley, Jr. et. al. discloses a non-pyrotechnic disseminator wherein the material to be disseminated may comprise finely divided powders suspended within a thixotropically gelled liquid which comprises at least a portion of liquefied gas. The only mention in this patent that the material has use as a fire extinguisher is a statement that all of the gelled liquid may consist of a liquefied gas, giving a composition having primary utility where the liquefied gas has the property of augmenting the functionality of the finely divided powder, as in the case of liquefied Freon being used in a fire extinguisher. There is no disclosure or suggestion in the patent that a fire suppressant agent permeates a carrier material resulting in a persistent fire suppressant composition.

British Patent No. 1,236,075 of Hollows discloses a nonaqueous fire extinguishing liquid, for example, bromochlorodifluoromethane, and a specific finely divided fire extinguishing powder. The powdered fire extinguishing material can be in the form of a dispersion or suspension in the fire extinguishing liquid, these states being assisted if desired by suitable dispersing agents. One or more of the known perhalocarbon liquid propellents can be mixed with the composition or its components. The specific fire extinguishing powder is that disclosed and claimed in British Patent No. 1,168,092 of Birchall which comprises the reaction product between urea and bicarbonates, carbonates, sesquicarbonates and hydroxides of sodium and potassium, having an empirical molecular formula of $MC_2N_2H_3O_3$, where M represents an atom of potassium or sodium.

German Auslegeschrift No. 1,211,493, dated Feb. 24, 1966, discloses a fire extinguishing composition especially for hand fire extinguishers consisting of a mixture of solid fire extinguishing powders, especially those based on carbonates, phosphates and sulfates, and liquid fluorinated (halo) paraffins, especially bromodifluoromethane and/or bromotrifluoromethane, which simultaneously act a propellants.

Australian Patent No. 227,557 of Warnock et al. discloses a dry chemical fire extinguishing composition comprising a dry chemical fire extinguishing powder, a powdered adsorbing agent and a gaseous expellant, a portion of the gaseous expellant being adsorbed by the adsorbing agent in an amount to maintain internal gaseous pressure in the container at a predetermined pressure at room temperature, the total amount of the gaseous expellant in the container being capable of expelling substantially most of the dry chemical in the container. The adsorbing agent can be silica gel, activated charcoal, attapulgus clay, synthetic zeolites, activated alumina, cracking catalysts of the type used in petroleum refining containing silica and various proportions of alumina, as well as the high surface area porous materials disclosed in U.S. Pat. Nos. 2,866,760. The expellant gas comprises a halogenated hydrocarbon and a gas selected from the group consisting of carbon dioxide, nitrogen, ethane, nitrous oxide and air.

U.S. Pat. No. 3,258,423 of Tuve et al. discloses a fire extinguishing composition known as "light water". It comprises potassium bicarbonate which may be silicone coated, water and particular types of perfluoro surfactants which form a stable foam when aerated with a gas, such as air or difluorodichloromethane. It is disclosed that the foam blocks the feedback of radiant energy to a fuel surface and prevents further release of flammable vapor after the flames have been suppressed, to prevent reignition of burning liquids, particularly.

U.S. Pat. No. 3,267,030 of Dessart discloses a dry powder type of fire extinguishing composition comprising 80–98% of a finely divided alkali metal bicarbonate, 1–19% of talc and 1–8% of very fine grain silica. The alkali metal bicarbonates may be coated with silicone oil. The composition is disclosed as possessing excellent compatability with foams and excellent mobility.

U.S. Pat. No. 3,609,074 of Rainaldi et al. discloses a flame extinguishing foam forming composition containing 5–25 weight percent of a bromine containing halogen saturated alkane of low carbon number ($C_1$ to $C_6$). The composition also contains substances conventional in foaming liquid flame extinguishing compositions, such as water, emulsifiers or foam stabilizing surfactants, propellents, antifreezing liquids, corrosion inhibitors, buffer substances, and thickening and carrying agents. Sodium silicates or potassium silicates are disclosed as the thickening and carrying agents.

U.S. Pat. No. 3,655,554 of Fink et al. discloses fire extinguishing compositions, such as foam forming liquids containing surface active substances, which are enhanced by incorporating into the agent about 1–10 weight percent of finely dispersed silica. It is preferred that the silica be present in the fire extinguishing liquids in colloidally dissolved form. The foaming agent and/or foam stabilizer may be mixed with the finely dispersed silica in dry form to obtain a powder which is then added to water to form the foam.

U.S. Pat. No. 4,042,521 of Dunn discloses a dry fire extinguishing composition comprising between about 50–95% of an alkali metal bicarbonate or alkaline earth metal carbonate and between about 50–5% of a metal silicate. Very small amounts of desiccants, such as magnesium stearate, talc, silica, silica gel, diatomaceous earth, calcium chloride, etc., may be added to the dry fire extinguishing composition to prevent the tendency of the composition to cake or agglomerate when subjected to moisture over long periods of time. The composition is disclosed as being effective in preventing flashback or reignition, particularly of Class B fires.

The composition of the present invention is neither disclosed nor suggested by any of the above-identified references and represents an improvement in persistent fire extinguishing and suppressing compositions.

SUMMARY OF THE INVENTION

The present invention comprises a substantially nonaqueous persistent thixotropic fire suppressant composition comprising a fire suppressant agent, a carrier material, the suppressant agent permeating the carrier material to form a suppressant permeated carrier material, a fire extinguishing dispersant, the carrier material being insoluble in the dispersant, the permeated carrier material being suspended in the dispersant, and a gelling agent in an amount effective to thixotropically gel the suspension of permeated carrier material and dispersant, the permeated carrier material being capable of adhering to an object in the vicinity of combustion.

The invention also includes a method of persistently suppressing combustion by dispersing the hereinafter described composition in the vicinity of a fire, whereby the permeated carrier material adheres to an object or objects in the vicinity of the fire and releases the permeating suppressant agent over a period of time. The relatively slow release of suppressant which permeates the carrier material is effective in preventing reignition of an extinguished fire and is also effective in preventing the spread of the fire to combustible fuel sources in the vicinity of the fire. The compositions according to the present invention are effective in persistently suppressing all classes of fires.

Definitions

The definitions given for the following terms shall apply throughout this application:

"Adhere" means to hold in contact with by means of chemical adhesion, thermoplastic adhesion, magnetic adhesion, electrostatic adhesion and/or mechanical adhesion.

"Dispersant" is a substance in which a solid material can be suspended under pressure, and which, upon the release of the pressure, as in being dispensed into the atmosphere from a pressurized container, propels, expels, spreads or disseminates the suspended solid material in all directions. "Percent" as applied to a component or ingredient of the composition means weight percent of the component or ingredient based on the total weight of the composition.

"Permeate" means to diffuse the permeating substance throughout the entire structure of the permeated material by means of absorption, adsorption, coating, impregnation, penetration, saturation and/or chemical combination in such a manner that the permeating substance is capable of being released from the permeated material.

"Persistent" with respect to the combustion suppressant qualities of the composition means that the ability of the composition to suppress combustion continues for a longer period of time than with compositions containing similar ingredients but which do not have a carrier material permeated with a suppressant agent.

"Substantially nonaqueous" with respect to the described and claimed composition means that the composition contains substantially no free water, although some hydrated solid suppressant agents and/or carrier materials may be present in the composition.

"Suppress" means to extinguish or to inhibit or to retard the growth or development of combustion. Thus, a suppressant agent extinguishes a fire, prevents reignition of the extinguished fire and may be used to prevent combustion of new fuel sources in the area of existing, potential or previously extinguished combustion.

DESCRIPTION OF THE PREFERRED EMBODIMENTS

The present invention is comprised of four principal components: a suppressant agent, a carrier material, a fire extinguishing dispersant and a gelling agent. Although some of these components may be present in prior art extinguishing compositions, they are combined according to the present invention in a synergistic manner to produce a stable, persistent and effective fire suppressing composition. It is believed that the composition according to the present invention possesses synergistic characteristics and produces a synergistic result when compared to the components of the composition when used separately or as combined in the prior art. Thus, in the present invention, the suppressant agent permeates the carrier material so that it is slowly released at or near the site of combustion.

Any suppressant agent capable of permeating a carrier material to provide a persistent action may be used in the compositions according to the present invention. In most cases, liquids having boiling points above about 40° F. are preferred because of their ability to easily permeate a carrier material. However, solids, solutions, suspensions, dispersions, and emulsions may also be effective suppressant agents. Typical solid suppressant agents include sodium salts, potassium salts, phosphates, carbonates, bicarbonates and the like. The suppressant may be released by a chemical reaction, such as the decomposition of a permeated carrier material which melts and decomposes upon contact with a hot surface.

The suppressant agent may include various halogenated hydrocarbon fire suppressant agents well known to those skilled in the art, such as 1,2-dibromotetrafluoroethane, having a vapor pressure of 14.7 psi absolute at 117.5° F., 1,2-difluorotetrachloroethane, having a vapor pressure of 14.7 psi absolute at 200° F., bromochloromethane, having a vapor pressure of 14.7 psi absolute at 152.6° F., dibromodifluoroethane, having a vapor pressure of 14.7 psi absolute at 76° F., and the like. The suppressant agent should be present in an amount of about 10 to about 60 weight percent of the total composition.

The essential feature of the carrier material used in the present composition is that it be able to be permeated with suppressant agent in such a fashion that the suppressant agent will be released from the carrier material over a period of time. This localizes the suppressant agent and causes the suppressant agent to be released over a period of time.

Porous minerals, such as vermiculite, perlite and clays, such as kaolinite and sodium montmorillonite, are examples of effective carrier materials which may be readily permeated with the suppressant agent. These materials, when permeated with suppressant agent, particularly gelled suppressant agent, are capable of adhering to objects.

Hydrated carrier materials, such as the clays described hereinbefore, Glauber's salt ($Na_2SO_4.10OH_2O$), sodium phosphate dodecahydrate ($Na_2PO_4.12H_2O$), and the like are already suppressant agent permeated carrier materials. The chemically combined water will be released when the hydrated carrier material is dispersed in the vicinity of a fire.

Porous polymeric resin materials, particularly of the foamed type, such as "STYROFOAM" polystyrene from Dow Chemical Company, are also effective carrier materials capable of being permeated with suppressant agent. Other types of polymeric resins which are suitable for use as carrier materials include polyethylene, polyurethane, polyvinylidene fluoride, silicone polymers, such as methyl vinyl polysiloxane available from General Electric Company, and the like. These porous polymeric resins adhere to the surface of an object by forming a melted adhesive coating on the hot surface of the object.

Where certain polymers, such as polyurethane, are flammable, suitable fire retardant additives may be added. Suitable fire retardant additives to the carrier material include decabromodiphenyl oxide and tetrabromophthalic anhydride, for example. Additionally, fire retardant materials, such as "Phosgard C-22-R", a chlorinated phosphorous polymer available from Monsanto Industrial Chemicals Company and "ABS Kynar", a fire retardant polyvinylidene fluoride available from Pennwalt Corporation, may be used as the carrier material.

Another type of carrier material adheres to combustible objects, such as textiles, by physical entanglement. This type of carrier material includes the small hook members made of nylon sold under the trademark "VELCRO" by Velcro Inc., and naturally occurring burrs, such as the seed pod of the cocklebur plant. The small hooks and barbs may be permeated with suppressant agent. The "VELCRO" hooks will not absorb the suppressant agent, but are sufficiently small and close together so that the suppressant agent, and particularly gelled suppressant agent, will cling to and coat them. This is within the definition of "permeate". The small hooks and barbs will then adhere to a combustible textile by becoming entangled within the textile fibers.

Another effective carrier material for use in the composition according to the present invention includes magnetic materials, such as magnetite or perforated hollow magnetic beads. The suppressant agent can permeate the pores of the naturally occurring magnetite or be contained within the hollow magnetic bead. This type of carrier material magnetically adheres to a magnetic object in the vicinity of the fire, such as engine compartment walls of vehicles.

A particularly effective persistent fire suppressant composition results when the carrier material permeated with the suppressant agent is at least partially coated with a thermoplastic polymeric resin, such as polyvinylidene fluoride, "ABS Kynar", silicone polymer, etc. The permeated carrier material adheres to a hot surface in the vicinity of the combustion by means of the melted adhesive characteristics of the polymeric coating. The coating may be applied before or after the suppressant agent permeates the carrier material. This provides for a suppressing action which persists over a longer period of time.

The carrier material preferably has a size where the average maximum dimension of the carrier material is about 0.02–0.25 inch. Carrier materials in this size range may be readily and stably suspended in a thixotropically gelled dispersant, are capable of being projected great distances and have suitable settling times to adequately coat objects in the vicinity of the combustion. Carrier materials having an average maximum dimension between about 0.02 and 0.05 inch are particularly preferred. The carrier material should be present in an amount of about 3 to about 40 weight percent of the total composition.

The dispersant used to propel the suppressant impregnated carrier material to the vicinity of the fire should be nonflammable, should have fire extinguishing capabilities and should have a vapor pressure greater than 14.7 psi absolute at ambient conditions. The dispersant is preferably a liquefied gas which can be thixotropically gelled. Fire extinguishing dispersants which may be thixotropically gelled include bromotrifluoromethane, perfluorocyclobutane, bromochlorodifluoromethane, fluorotrichloromethane and dichlorodifluoromethane, for example. The fire extinguishing dispersant should be present in an amount of about 10 to about 60 weight percent of the total composition.

The other essential component of the compositions according to the present invention is a gelling agent in an amount effective to thixotropically gel the suspension of permeated carrier material and dispersant. Generally, about 0.5 to about 5% of the composition should be gelling agent. Suitable gelling agents include, for example, pyrogenic silica derived from the combustion of silicon tetrachloride, such as that commercially available under the trademark "Cab-O-Sil" from Cabot Corp., organo modified montmorillonite clay (a tetraalkyl ammonium smectite) of the type available from N.L. Industries, Inc. under the trademark "BENTONE 38", oleophilic vinyl addition polymer (lightly cross-linked) of a type available from Dow Chemical Company under the trademark "XVS00100.000", and other submicron salts well known to those skilled in the art.

The gelling agent is used to make the composition according to the present invention thixotropic, whereby the composition acts as a liquid when subjected to mechanical stress, as would occur during filling and dispensing from containers, and returns to the gel form when at rest, as when the composition is being stored. The thixotropic fire suppressant composition should have a yield stress sufficiently high to prevent settling, compacting and agglomeration of the permeated carrier material and any additives, yet be sufficiently low to provide for ready liquefication of the gel during transportation and dispensing. A suitable yield stress would be between about 20 and 500 dynes/cm$^2$, a yield stress of 200 dynes/cm$^2$ being particularly preferred.

If desired, a gelling agent may be added to the suppressant agent in an amount effective to thixotropically gel the suppressant agent before and after it permeates the carrier material. This is particularly desirable when the carrier material is of a type which does not have a large surface area to retain a substantial amount of ungelled suppressant agent. It is contemplated that a thixotropically gelled suppressant agent would be most suitable for use with carrier materials comprising hollow, perforated beads, the small hook members and the burrs.

Additional fire extinguishing additives may be incorporated into the thixotropically gelled composition. These provide the fire extinguishing dispersant with additional ability to immediately extinguish fires, after which the persistent permeated carrier material acts to suppress reignition of the fire. These agents may include the well known powdered alkali metal carbonates and bicarbonates, such as sodium carbonate, potassium carbonate, sodium bicarbonate and potassium bicarbonate, antimony oxide, ammonium phosphate, tetramethylthiuram disulfide, and the like. These additives are retained as a stable suspension in the thixotropic gel.

Evaporation tests of Freon 114B2 permeated in vermiculite compared to an equivalent amount of Freon 114B2 by itself showed that the permeated suppressant agent evaporated in about fifteen minutes compared to about three minutes for the suppressant agent by itself. Thus, it is believed that the suppressant action will persist about five times longer with the permeated suppressant agent. Compositions according to the present invention wherein the suppressant permeated carrier material is coated with a polymeric resin are believed to be capable of much longer persistency. The time of effective suppression depends upon the amount of the composition applied to a fire, the type of fire, the type of surfaces to which the permeated carrier material adheres, the temperature in the area and other variable factors. The compositions according to the present invention may be used preventively by dispersing the compositions in the path of an oncoming fire in addition to their use to extinguish a fire and to suppress its reignition.

The compositions according to the present invention may be stored and dispensed from any suitable container capable of withstanding the pressures generated by the gelled liquefied gas dispersant. Such containers are well known to those skilled in the art, and include, for example, those of the type disclosed in U.S. Pat. No. 3,402,665 of Tarpley, Jr. et al.

The present invention will now be described in more detail with reference to the following specific, nonlimiting examples. To aid in understanding the examples, the ingredients are listed in two groups. The first group, labeled "Persistent Material" includes the suppressant agent, the carrier material to be permeated by the suppressant agent and, where applicable, the gelling agent for the suppressant agent. The second group, labeled "Extinguishing Dispersant" includes the fire extinguishing dispersant, the gelling agent for the dispersant and additives, if any.

EXAMPLE 1

| Ingredient | Weight Percent |
|---|---|
| Persistent Material | |
| chopped polyurethane foam particles | 21.0 |
| 1,2-dibromotetrafluoroethane | 24.0 |
| Extinguishing Dispersant | |
| bromotrifluoromethane | 53.5 |
| colloidal silica | 1.5 |

The foam particles are placed in excess suppressant agent, 1,2-dibromotetrafluoroethane, and the mixture is stirred. The chopped foam particles are maintained in contact with the suppressant agent with stirring until the suppressant agent permeates the particles. This may be determined by weighing the particles after mixing them in the suppressant agent for various periods of time. When the weight of the particles after draining the excess suppressant agent is constant, the suppressant agent is considered to have fully permeated the carrier material.

The gelling agent, colloidal silica, is added to the fire extinguishing dispersant, bromotrifluoromethane, in a vessel within a pressure chamber. The drained permeated carrier material is then thoroughly mixed in with the gelled dispersant. The thixotropically gelled composition is then placed within a dispensing container within the pressure chamber and sealed before being removed from the chamber.

Example 2 illustrates a composition according to the present invention wherein a fire extinguishing powder, $KHCO_3$, is also suspended in the gelled dispersant. Otherwise, the method is the same as Example 1.

EXAMPLE 2

| Ingredient | Weight Percent |
|---|---|
| Persistent Material | |
| chopped polyurethane foam particles | 11.0 |
| 1,2-dibromotetrafluoroethane | 14.0 |
| Extinguishing Dispersant | |
| bromotrifluoromethane | 53.5 |
| colloidal silica | 1.5 |
| $KHCO_3$ | 20.0 |

The method of making the compositions illustrated in Examples 3–5 is basically the same as the method of Example 1.

EXAMPLE 3

| Ingredient | Weight Percent |
|---|---|
| Persistent Material | |
| methyl vinyl polysiloxane (porous) | 6.0 |
| 1,2-dibromotetrafluoroethane | 34.0 |
| Extinguishing Dispersant | |
| bromochlorodifluoromethane | 58.3 |
| colloidal silica | 1.7 |

EXAMPLE 4

| Ingredient | Weight Percent |
|---|---|
| Persistent Material | |
| polyvinylidene fluoride resin (porous) | 5.0 |
| 1,2 dibromotetrafluoroethane | 35.0 |
| Extinguishing Dispersant | |
| bromotrifluoromethane | 57.3 |
| Bentone 38 | 2.7 |

EXAMPLE 5

| Ingredient | Weight Percent |
|---|---|
| Persistent Material | |
| vermiculite | 3.0 |
| tetrachlorodifluoroethane | 37.0 |
| Extinguishing Dispersant | |
| bromotrifluoromethane | 58.3 |
| colloidal silica | 1.7 |

EXAMPLE 6

| Ingredient | Weight Percent |
|---|---|
| Persistent Material | |
| vermiculite | 3.0 |
| dibromodifluoromethane | 37.1 |
| polyvinylidene fluoride resin (coated on permeated vermiculite) | 0.5 |
| Extinguishing Dispersant | |
| bromotrifluoromethane | 58.9 |
| Dow XVS00100.000 | 0.5 |

The composition illustrated by Example 6 is prepared in a manner similar to the preparation of the compositions illustrated in the previous examples, except that before the dibromodifluoromethane permeates the vermiculite, the vermiculite is partially coated with the polyvinylidene fluoride. The vermiculite particles are partially coated by contacting a portion of the surface of the particles with molten resin. The partially coated permeated material is then suspended in the thixotropically gelled dispersant as before.

Examples 7-10 illustrate the use of a gelled suppressant agent which permeates the carrier material, in Example 7 a naturally occurring seed pod. Dry fire extinguishing powder, $NH_4H_2PO_4$, is also added to the thixotropically gelled dispersant in Example 7.

EXAMPLE 7

| Ingredient | Weight Percent |
|---|---|
| Persistent Material | |
| cocklebur | 4.0 |
| bromochloromethane | 21.0 |
| colloidal silica | 0.5 |
| Extinguishing Dispersant | |
| bromotrifluoromethane | 53.0 |
| colloidal silica | 1.5 |
| $NH_4H_2PO_4$ | 20.0 |

EXAMPLE 8

| Ingredient | Weight Percent |
|---|---|
| Persistent Material | |
| "VELCRO" hook members | 4.0 |
| 1-2,-dibromotetrafluoroethane | 53.2 |
| colloidal silica | 1.5 |
| Extinguishing Dispersant | |
| bromotrifluoromethane | 40.0 |
| colloidal silica | 1.3 |

EXAMPLE 9

| Ingredient | Weight Percent |
|---|---|
| Persistent Material | |
| porous magnetite | 17.3 |
| 1,2-dibromotetrafluoroethane | 40.0 |
| colloidal silica | 1.4 |
| Extinguishing Dispersant | |
| bromotrifluoromethane | 40.0 |
| colloidal silica | 1.3 |

EXAMPLE 10

| Ingredient | Weight Percent |
|---|---|
| Persistent Material | |
| hollow perforated magnetic iron beads | 32.0 |
| 1,2-dibromotetrafluoroethane | 16.0 |
| colloidal silica | 0.5 |
| Extinguishing Dispersant | |
| bromotrifluoromethane | 50.0 |
| colloidal silica | 1.5 |

The hollow magnetic iron beads used as the carrier material in Example 10 are perforated. The beads are mixed in a pressure chamber with the gelled 1,2-dibromotetrafluoroethane and the pressure in the chamber is then increased to drive the gelled suppressant agent into the interior of the beads, since the pressure in the interior of the beads is less than the increased pressure. The permeated beads are suspended in the thixotropically gelled dispersant and placed in a container as in the other examples.

The present invention may be embodied in other specific forms without departing from the spirit or essential attributes thereof and, accordingly, reference should be made to the appended claims, rather than the foregoing specification as indicating the scope of the invention.

We claim:

1. A nonaqueous persistent thixotropic fire suppressant composition comprising a fire suppressant agent, a carrier material, said suppressant agent permeating said carrier material to form a suppressant permeated carrier material, a fire extinguishing dispersant, said carrier material being insoluble in said dispersant, said permeated carrier material being suspended in said dispersant, and a gelling agent in an amount effective to thixotropically gel said suspension of permeated carrier material and dispersant, said permeated carrier material being capable of adhering to an object in the vicinity of combustion.

2. A composition according to claim 1 comprising about 10 to about 60 percent of said suppressant agent, about 3 to about 40 percent of said carrier material, about 10 to about 60 percent of said dispersant, and about 0.5 to about 5 percent of said gelling agent.

3. A composition according to claim 1 wherein said suppressant agent is selected from the group consisting of 1,2-dibromotetrafluoroethane, tetrachlorodifluoroethane, dibromodifluoromethane and bromochloromethane, said carrier material is selected from the group consisting of hollow perforated beads, porous inorganic minerals, porous polymeric resin material, hydrated compounds and naturally occurring burrs, said dispersant is selected from the group consisting of bromotrifluoromethane, perfluorocyclobutane, bromochlorodifluoromethane, fluorotrichloromethane and dichlorodifluoromethane, and said gelling agent is selected from the group consisting of colloidal silica, oleophilic vinyl addition polymer and organo modified montmorillonite clay.

4. A composition according to claim 3 wherein said suppressant agent is present in an amount of about 10 to about 60 percent, said carrier material is present in an amount of about 3 to about 40 percent, said dispersant is present in an amount of about 10 to about 60 percent and said gelling agent is present in an amount of about 0.5 to about 5 percent.

5. A composition according to claim 3 wherein said inorganic mineral is selected from the group consisting of vermiculite, perlite, magnetite, sodium montmorillonite, kaolinite, and mixtures thereof, said polymeric resin material is selected from the group consisting of polystyrene, polyurethane, polyvinylidene fluoride, silicone polymers and mixtures thereof and said hydrated compound is selected from the group consisting of sodium sulfate decahydrate and sodium phosphate dodecahydrate and mixtures thereof.

6. A composition according to claim 1 wherein said suppressant agent is gelled.

7. A composition according to claim 6 wherein said carrier material comprises polymeric resin hook members, said gelled suppressant agent permeating said hook members.

8. A composition according to claim 1 further comprising fire retardant additives selected from the group consisting of potassium carbonate, potassium bicarbonate, antimony oxide, ammonium phosphate, decabromodiphenyl oxide, tetrabromophthalic anhydride, chlorinated phosphorous polymer and tetramethylthiuram disulfide.

9. A composition according to claim 1 wherein said permeated carrier material includes a coating of a thermoplastic resin.

10. A method of persistently suppressing combustion by dispersing the composition of any one of claims 1 to 9 in the vicinity of a fire, whereby said permeated carrier material adheres to said object and releases said permeating suppressant agent over a period of time.

* * * * *